US005368194A

United States Patent [19]

Oliff et al.

[11] Patent Number: 5,368,194

[45] Date of Patent: Nov. 29, 1994

[54] ROLL-OUT DISPENSER FOR A BEVERAGE CARTON

[75] Inventors: James R. Oliff, Austell; James T. Stout, Ellijay, both of Ga.

[73] Assignee: The Mead Corporation, Dayton, Ohio

[21] Appl. No.: 114,729

[22] Filed: Aug. 31, 1993

[51] Int. Cl.[5] ..... A47F 1/04

[52] U.S. Cl. ..... 221/305; 221/124; 221/303; 221/306; 221/309; 206/430; 206/427

[58] Field of Search ..... 221/305, 303, 306, 307, 221/308, 309, 123, 124; 206/139, 430, 427

[56] References Cited

U.S. PATENT DOCUMENTS

| | | | |
|---|---|---|---|
| 1,628,439 | 5/1927 | Staubly | 221/305 X |
| 1,682,838 | 9/1928 | Feigelman | 221/305 X |
| 3,300,115 | 1/1967 | Schauer | 221/309 X |
| 3,332,594 | 7/1967 | De Capua | 221/309 X |
| 3,540,581 | 11/1970 | Koolnis | 206/193 |
| 3,894,681 | 7/1975 | Arneson et al. | 221/305 |
| 4,364,509 | 12/1982 | Holley, Jr. et al. | 221/305 |
| 4,396,143 | 8/1983 | Killy | 221/305 X |
| 4,817,866 | 4/1989 | Wonnacott | 221/303 X |
| 5,234,102 | 8/1993 | Schuster et al. | 206/141 |

*Primary Examiner*—Robert P. Olszewski
*Assistant Examiner*—Dean A. Reichard
*Attorney, Agent, or Firm*—Thomas A. Boshinski

[57] ABSTRACT

A package for beverage containers such as cans arranged in two or more axially-stacked tiers includes a carton having interconnected top, bottom and side walls. End closure structure connected to at least some of the walls closes one end of the carton. A dispenser for the containers includes first and second apertures defined in the end closure structure. The first aperture extends from one of the side walls and the bottom wall into the end closure structure, and the second aperture extends from the same side wall and the top wall into the end closure structure. The first and second apertures terminate remote from each other such that a portion of the end closure structure extends between the apertures and is connected to the side wall.

15 Claims, 4 Drawing Sheets

ROLL-OUT DISPENSER FOR A BEVERAGE CARTON

BACKGROUND OF THE INVENTION

The present invention relates generally to paperboard cartons for use in packaging beverage containers such as cans. More particularly, the invention relates to a roll-out type dispenser whereby individual cans may be easily removed from the carton. The invention is especially useful for a beverage carton in which the containers are arranged in two or more tiers.

Containers such as cans for beverages including soft drinks, beer, juices and the like are commonly sold in multiple quantities packaged in a paperboard carton. Typically, the cans are arranged in a single-tier, rectangular matrix. A common feature provided for such cartons is a roll-out dispenser, whereby the consumer may easily remove single cans without having to tear large openings in the carton. Such a feature is provided at one end of the carton, and comprises an aperture extending fully across one of the end walls. The elongate aperture is aligned with the cylindrical axis of the cans. At least a portion of the aperture is of a width somewhat less than the can diameter, so that a can will be retained within the carton, but will present itself at the aperture. The paperboard has sufficient flex that the consumer can pull the can from the aperture without damaging the surrounding paperboard. An example of such a dispenser can be seen by reference to U.S. Pat. No. 4,364,509.

Recently, attempts have been made to introduce into the marketplace beverage cartons wherein the cans are arranged in two tiers, with corresponding cans from each tier being axially aligned. An example of such a carton can be seen by reference to U.S. Pat. No. 5,234,102.

The conventional roll-out type dispenser is not well suited for use with a two-tier beverage carton. Applying an elongate aperture across the end wall of the carton exposes two cans for removal, one from each tier. In such a case, removal of one can may cause the second can to fall from the aperture. Moreover, the length of the aperture and resulting additional flexing of the paperboard along the aperture boundary reduces the ability of the paperboard to retain the remaining cans within the carton. Thus, additional cans may roll out from the dispenser unexpectedly.

What is needed, therefore, is a roll-out type dispenser which is usable with a two-tier carton for cans. Such a feature should retain all of the conveniences of currently known roll-out dispenser features, and should not add significantly to the cost or complexity of the carton design and/or manufacture.

SUMMARY OF THE INVENTION

In accordance with one embodiment, the present invention is provided for use in a package for beverage containers such as cans of predetermined height and diameter in two or more axially-stacked tiers. The package includes a carton having interconnected top, bottom and side walls, and end closure structure connected to at least some of the walls for closing one end of the carton. The containers are arranged within the carton with their axes parallel to the side walls.

In accordance with the invention, a dispenser for the containers includes first and second apertures defined in the end closure structure, the first aperture extending from one of the side walls and the bottom wall into the end closure structure. The second aperture extends from the one side wall and the top wall into the end closure structure. The first and second apertures terminate remote from each other such that a portion of the end closure structure extends between the apertures and is connected to the one side wall.

The first and second apertures may define extension portions which extend partially into adjacent portions of the bottom and top walls respectively. The extension portions may be defined at least in part by an aperture edge, with the distance between the end closure structure and a portion of the aperture edge most remote therefrom being less than the diameter of the beverage container.

The first and second apertures may each be covered by an at least partially removable cover flap. The cover flap is removably connected to the end closure structure along a perforated tear line. The cover flap may be connected to the side wall along a fold line.

Preferably, the first and second apertures may be defined in the end closure structure to each extend therealong from respective ones of the top wall and the bottom wall to define a length for each of the apertures less than the container height. Additionally, the first and second apertures may each be defined in the end closure structure to extend therealong from the one of the side walls to define a width for each of the apertures that along at least a portion of the aperture is less than the container diameter. In one embodiment, the aperture may be of a width less than the container diameter adjacent to the respective one of the top wall and the bottom wall.

The package may further comprise an insert panel positioned within the carton to divide the tiers, the panel along one end thereof being disposed adjacent to the end closure structure. Preferably, the insert panel is attached to an inner surface of the end closure structure, at least in part along the portion thereof that extends between the apertures.

In accordance with an alternate embodiment, the present invention may provide a blank for forming a carton for packaging beverage containers such as cans of predetermined height and diameter in two or more axially-stacked tiers, the blank including sequentially interconnected top, side and bottom wall panels, and first and second major end flaps connected to a side edge of each of the top and bottom wall panels respectively and extending outwardly therefrom to an outer edge. A dispenser for the containers includes first and second removable cover panels defined along tear lines in the first and second major end flaps respectively. The first cover panel extends from the bottom wall panel along a side edge of the first major end flap closest to the side wall panel, and terminating along the first major end flap remote from the outer edge thereof. The second cover panel extends from the top wall panel along a side edge of the second major end flap closest to the side wall panel, and terminating along the second major end flap remote from the outer edge thereof.

In this embodiment, the first and second cover panels may define extension portions which extend partially into adjacent portions of the bottom and top walls respectively.

In accordance with a still further embodiment of the invention, a dispenser is provided for use in a package for beverage containers such as cans of predetermined height and diameter, the package including a carton having interconnected top, bottom and side walls, and end closure structure connected to at least some of the walls for closing one end of the carton. The containers are arranged within the carton in at least a single tier with their axes parallel to the side walls.

The dispenser for the containers comprises a first aperture defined in the end closure structure, the first aperture extending from one of the side walls and one of the bottom and top walls into the end closure structure. The first aperture extends therealong from the one of the top wall and the bottom wall to define a length for the first aperture less than the container height, and extends along the end closure structure from the one of the side walls to define a width for the first aperture that along at least a portion of the aperture is less than the container diameter.

The containers may be arranged within the carton in two axially-aligned tiers. In such a case, the dispenser may further include a second aperture defined in the end closure structure, the second aperture extending from the one of the side walls and another of the bottom and top walls into the end closure structure. The second aperture extends therealong from such other of the top wall and the bottom wall to define a length for the second aperture less than the container height, and extends along the end closure structure from the one of the side walls to define a width for the second aperture that along at least a portion of the aperture is less than the container diameter.

DETAILED DESCRIPTION OF THE PREFERRED EMBODIMENT

Figure 1:
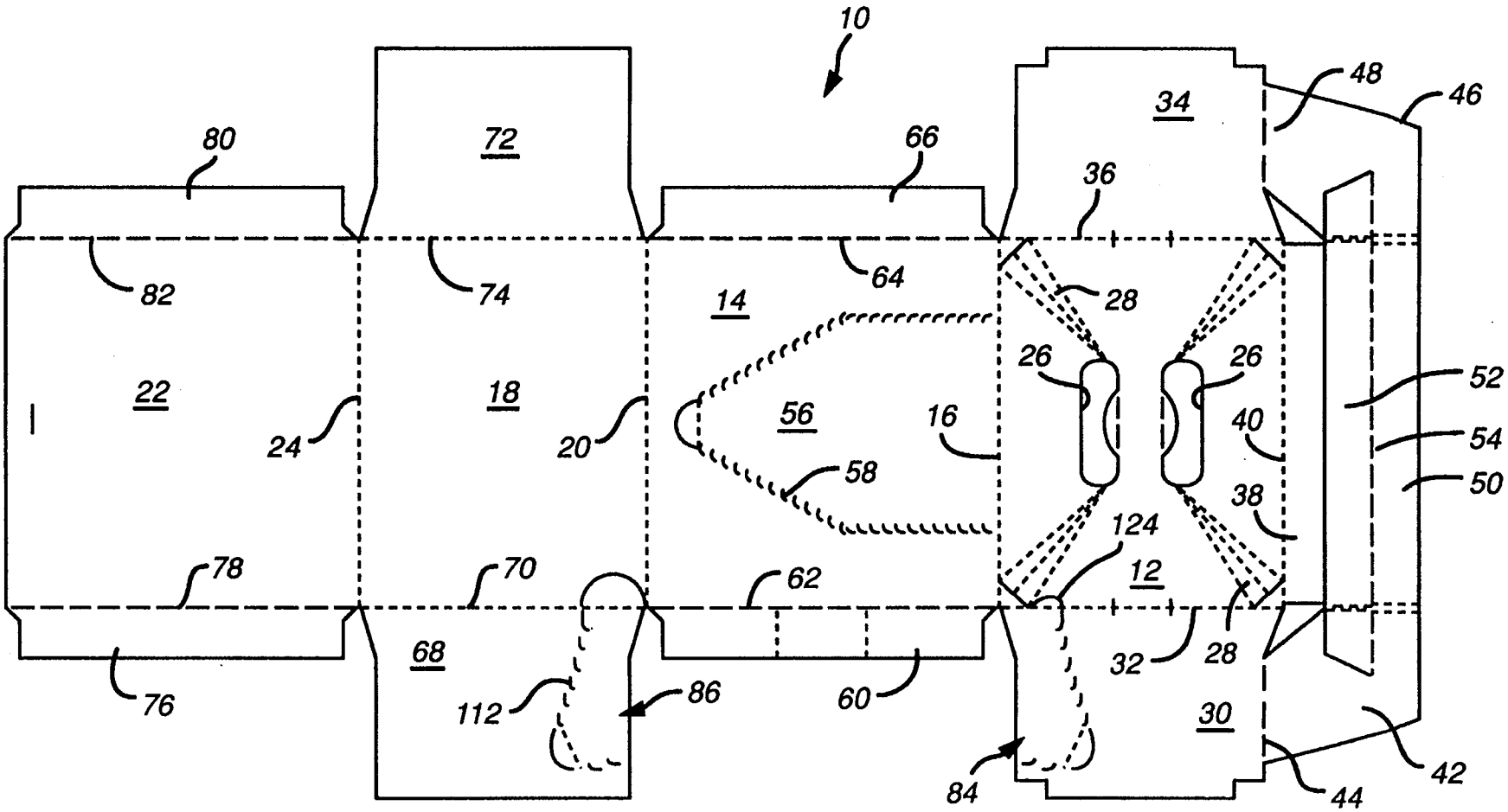
FIG. 1 is a plan view of the inner surface of a blank for forming a carton incorporating a dispenser in accordance with the present invention.

A carton for use in connection with the present invention may be seen in blank form by reference to FIG. 1. The carton includes a top wall panel 12 connected to a side wall panel 14 along fold line 16. A bottom wall panel 18 is connected to side wall panel 14 along fold line 20, and at its opposite side is connected to side wall panel 22 along fold line 24.

Top wall panel 12 includes a pair of hand apertures 26 for forming a handle structure for the carton. Additionally, reinforcing fold lines 28 extend from apertures 26 toward the corners of top wall panel 12, in accordance with the handle structure disclosed in U.S. Pat. application Ser. No. 08/065,277. A major end flap 30 is connected at one end edge of top wall panel 12 along fold line 32, while a second major end panel 34 is connected at the opposite end of top wall panel 12 along fold line 36. A glue flap 38 is connected to top wall panel 12 along fold line 40.

A handle reinforcing structure is connected to each of major end flaps 30 and 34, and comprises end portion 42 connected to major end flap 30 along fold line 44, and end portion 46 connected to major end flap 34 along fold line 48. A central portion 50 interconnects end portions 42 and 46. An auxiliary handle reinforcing strip 52 is connected to central portion 50 along a fold line 54.

Side wall panel 14 includes a removable access panel 56 defined by a perforated tear line 58. Connected at one end edge of side wall panel 14 along fold line 62 is a minor end flap 60, and connected by a fold line 64 at an opposite end edge is minor end flap 66.

Bottom wall panel 18 has a major end flap 68 connected along fold line 70 at one end edge thereof, while a second major end flap 72 is connected at an opposite end edge along fold line 74.

Finally, side wall panel 22 includes a minor end flap 76 connected at one end edge along fold line 78, and a minor end flap 80 connected along fold line 82 at the opposite end edge.

In accordance with the present invention, and as will be described in greater detail herein, a dispenser means 84 has its major portion formed within major end flap 30. A similar dispenser means 86 has its major portion formed in major end flap 68.

Figure 3:
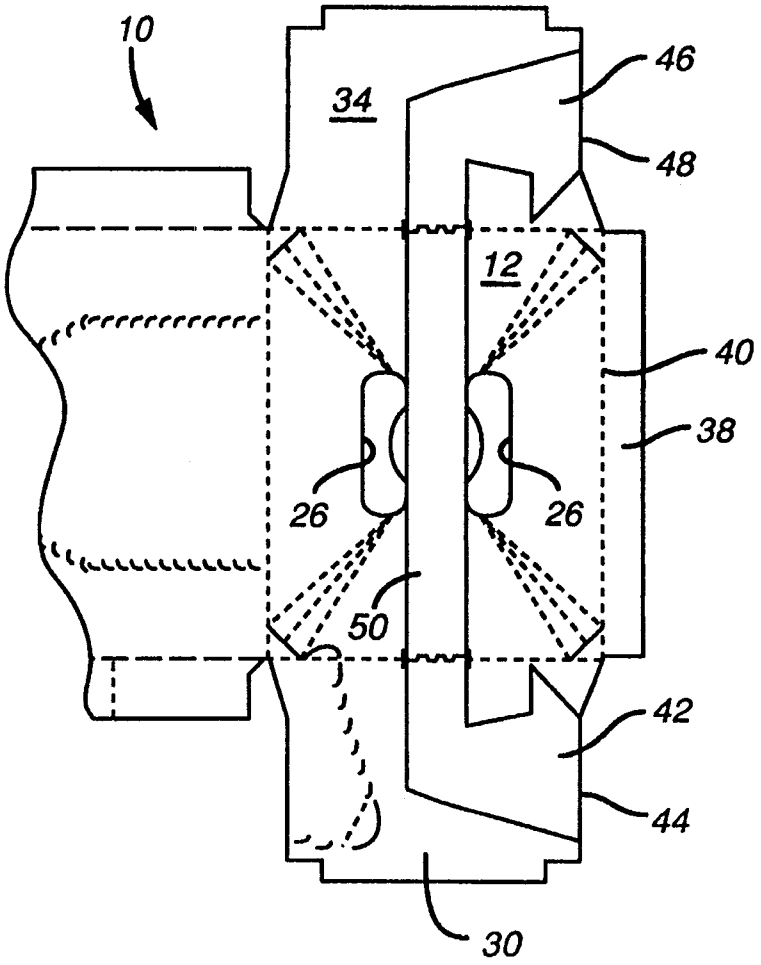
FIG. 3 is a partial plan view similar to FIG. 2, showing a further step in the formation of a carton from the blank of FIG. 1.
Figure 2:
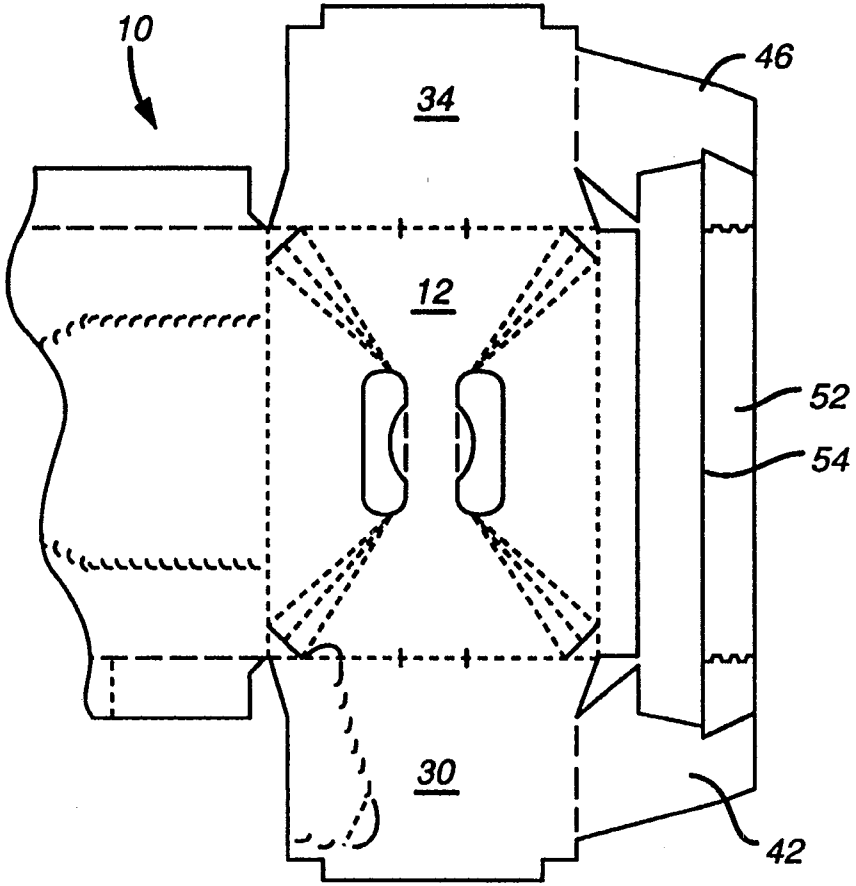
FIG. 2 is a partial plan view similar to FIG. 1, showing a first step in the formation of a carton from the blank of FIG. 1.

Referring now to FIG. 2, a portion of the blank for carton 10 can be seen, showing the beginning of the assembly process for the carton. Auxiliary reinforcing strip 52 is folded about fold line 54 and glued to the central portion of handle reinforcing structure, extending between end portions 42 and 46. Next, as shown in FIG. 3, the handle reinforcing structure is folded about fold lines 44 and 48, and end portions 42 and 46 are glued to major end panels 30 and 34, respectively. Central portion 50, and the auxiliary reinforcing flap 52 adhered thereto, are glued to top wall panel 12, so as to extend along the region between the hand apertures 26. Thus, a triple-ply reinforced structure between the apertures 26 is formed. Thereafter, as is conventional and is not shown in the drawings, side wall panel 22 is glued to glue flap 38, in order to form a collapsed tubular structure which can be subsequently erected for loading.

Figure 4:
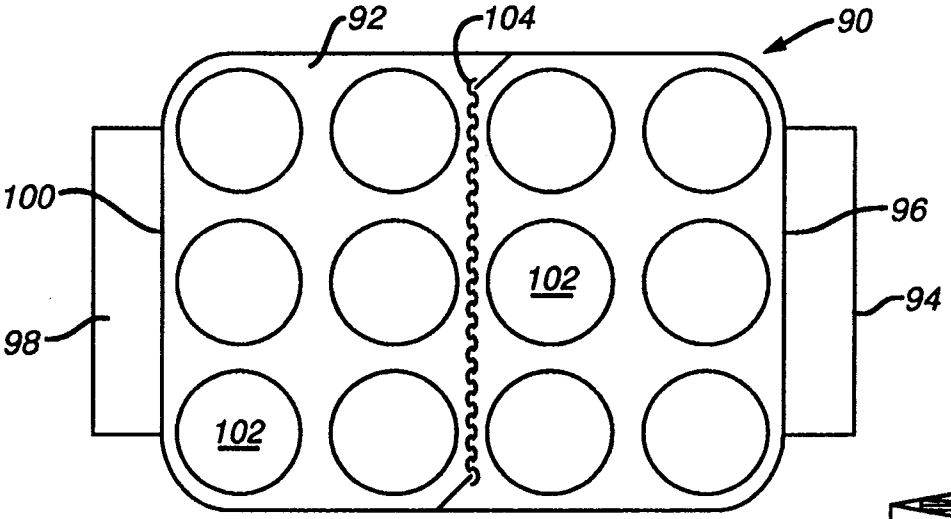
FIG. 4 is a plan view of an insert for use in connection with a carton formed from the blank of FIG. 1.

In addition to carton 10, the package for cans in accordance with the present invention may include a dividing insert 90, shown in blank form in FIG. 4. Insert 90 includes a main panel 92, having an end flap 94 attached at one end along a fold line 96, and an end flap 98 attached at the opposite end along fold line 100. Main panel 92 may preferably be formed with embossments 102, which are approximately the diameter of the ends of the cans to be packaged, and are used for purposes of locating and seating the cans when packaged within the carton. In addition, a tear line 104 may be provided across main panel 92, enabling the insert 90 to be torn when in place within carton 10 by the consumer for removal of cans from the lower tier.

Figure 5:
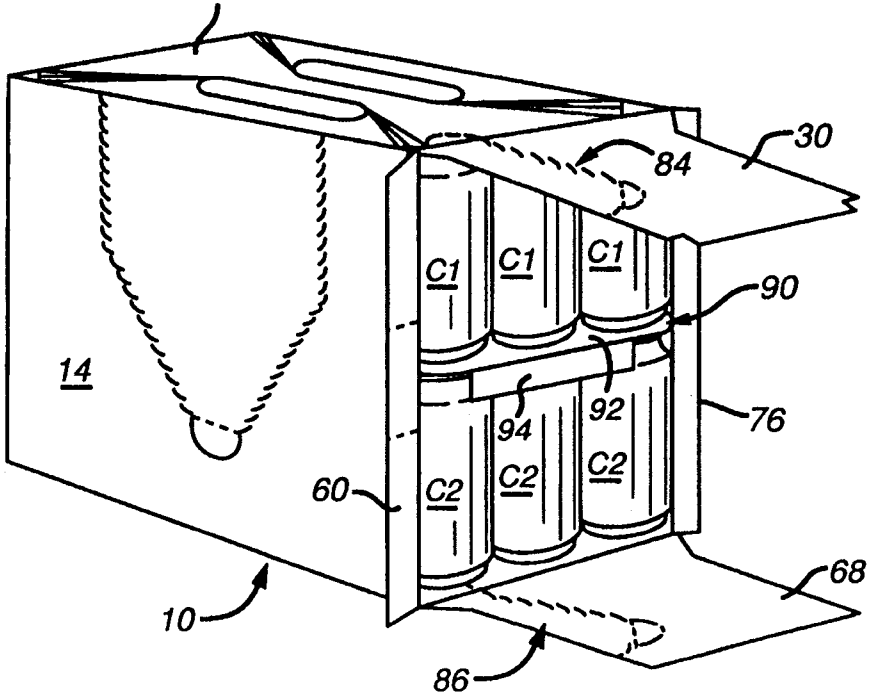
FIG. 5 is a three-quarter view of the top, side and end of an erected and loaded carton formed from the blank of FIG. 1, showing the end closure structure prior to folding and sealing.

An erected and loaded carton may be seen by reference to FIG. 5. The carton 10 is shown with its end closure structure, comprising major end flaps 30 and 68 and minor end flaps 60 and 76, open prior to the application of glue for sealing. Cans C1 of the upper tier are positioned on the main panel 92 of insert 90. Main panel 92 in turn rests upon the tops of the cans C2 of the lower tier. Cans C2 are in turn positioned on the bottom wall panel 18 of the carton 10.

Closure and sealing of the end closure structure is effected in the following manner (not shown). Minor end flaps 60 and 76 are folded to a closed position against the packaged cans. Glue is applied to minor end flaps 60 and 76 and, preferably, to the end flap 94 of insert 90. Major end flap 30 is then folded downwardly and secured to the flaps 60, 76 and 94. Additional glue is applied to the outer end of the inner surface of major end flap 68, which is folded upwardly and sealed to major end flap 30.

An identical operation is carried out to close and seal end closure structure located at the opposite end of the carton.

Figure 6:
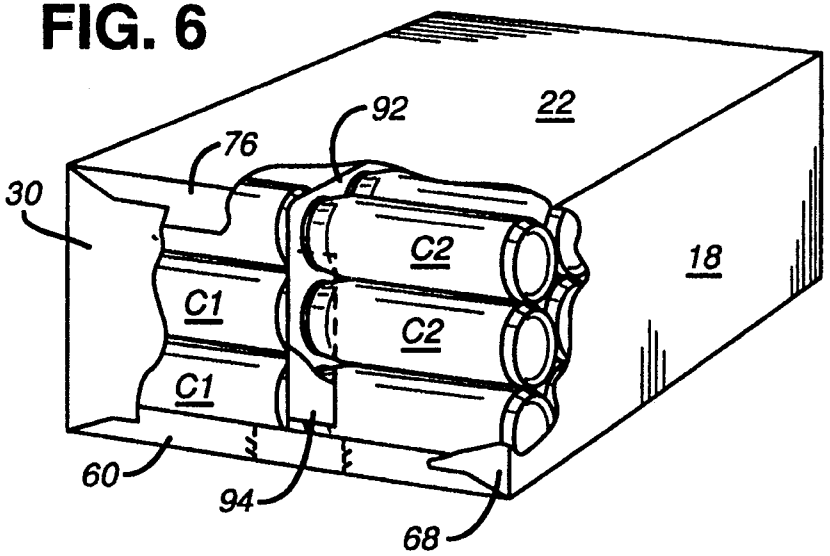
FIG. 6 is a three-quarter view of the side, bottom and top of the carton of FIG. 5, showing the end closure structure broken away to illustrate the arrangement of beverage containers within the carton.

The loaded carton may be seen in a cutaway view by reference to FIG. 6. The carton is positioned on its side wall panel 14, whereby it can be seen that bottom wall 18 and divider main panel 92 define a lane for the cans C2 of the lower tier, while divider main panel 92 and the top wall panel 12 define a lane for the cans C1 of the upper tier.

Figure 7:
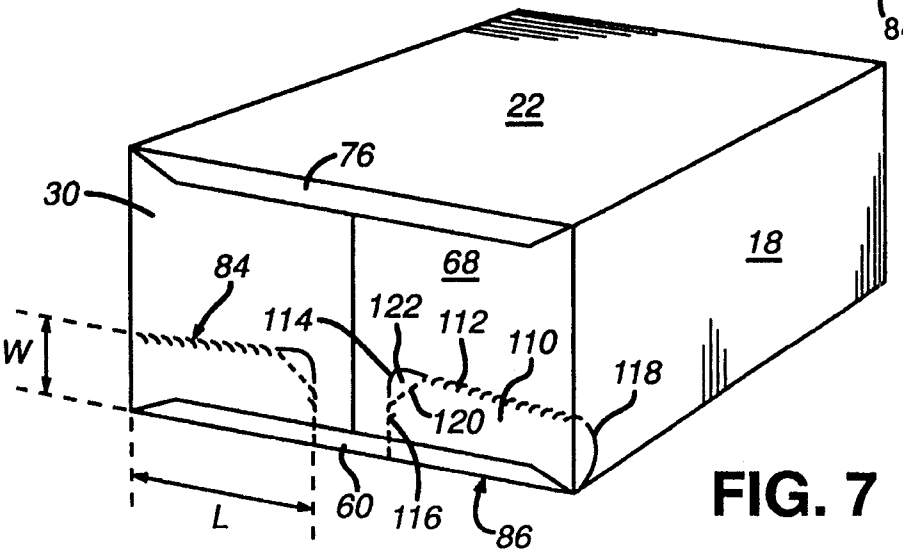
FIG. 7 is a view similar to FIG. 6, but showing the end closure structure intact to illustrate the dispenser of the present invention.

The dispenser means in accordance with the present invention can be seen by reference to FIG. 7. Referring, for example, to dispenser means 86, a dispenser cover 110 is defined by a generally horizontal perforated tear line 112 formed in major end flap 68, an arcuate corner cut line 114 formed in major end flap 68, and a substantially vertical perforated tear line 116 formed in major end flap 68 and minor end flap 60. In addition, a perforated arcuate tear line 118 is formed in bottom wall panel 18, extending from the lower corner of bottom wall panel 18 to a point on the edge of bottom wall panel 18 adjacent perforated tear line 112. Additionally, a fold line 120 is formed in major end flap 68, connecting the ends of cut line 114. Cut line 114 and fold line 120 thus define a pull tab 122 to facilitate opening of the dispenser means by the consumer.

Dispenser means 84 is constructed similarly, although in mirror image form, and will not be described in detail. However, it should be noted by reference to FIG. 1 that arcuate perforated tear line 124 formed in top wall panel 12 is configured slightly differently from perforated tear line 118 formed in bottom wall panel 18. As can be seen, it may be necessary to slightly alter the configuration of this portion of the dispenser means as a result of handle reinforcement structure, or other portions of the carton located in the top wall panel (or even bottom wall panel).

As can be seen, a portion of the end closure structure extends between the two dispenser means 84 and 86 and is connected to the adjacent side wall panel. This connecting portion comprises part of major end flaps 30 and 68 and minor end flap 60. Also, by reference back to FIG. 6, it can be seen in the preferred embodiment that flap 94 of insert 90 is glued to such connecting portion of the end closure structure. This prevents flap 94 from interfering with the operation of the dispenser means.

Further in FIG. 7, it should be noted that the length L of the aperture defined in the carton end closure structure for each dispenser means is of a distance less than the axial height of the packaged cans. In addition, at least some portion of the width W of the dispenser aperture is somewhat less than the diameter of the packaged cans. This is necessary in order to prevent the packaged cans from spontaneously falling from the carton through the dispenser apertures.

Figure 8:
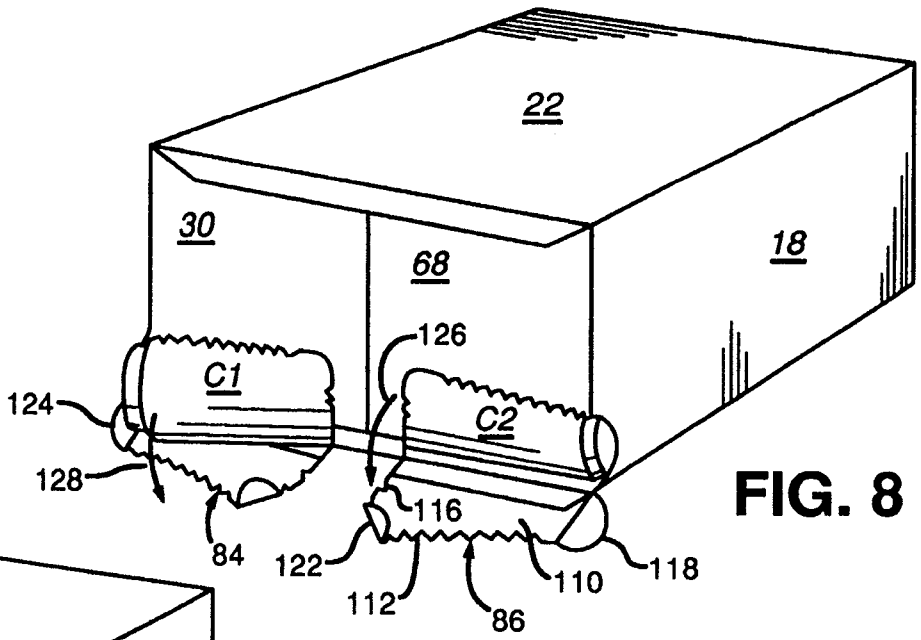
FIG. 8 is a view similar to FIG. 7, showing the dispenser in use.

Referring now to FIG. 8, removal of the cans using the dispensing means can be seen. The user presses inwardly on tab 122, which is easily separated from major end flap 68 as a result of cut line 114. Cover panel 110 may then be gripped and pulled outwardly and downwardly as shown by arrow 126. This causes perforated tear lines 112, 116 and 118 to separate, thereby exposing the can C2 disposed inside the carton. However, as explained above, as a result of the length and width of the dispenser aperture, can C2 will not spontaneously roll out of the carton through the dispenser aperture.

Removal of a can C1 can be seen by referring to dispensing means 84. As a result of arcuate perforated tear line 124, a portion of the end of can C1 is exposed. The user may place a finger on the can end, and move the can C1 outwardly of the carton, using a generally pivoting motion as illustrated by arrow 128. This pivoting force flexes the paperboard in the region of the dispenser aperture, thereby permitting the can to be pulled outwardly from the carton. Once the can is removed, cans positioned above the removed can will drop downwardly, thereby presenting another can for removal from the dispenser.

It can be seen, for example from FIG. 1, that tear line 112, while generally parallel to the axes of the cans in the loaded carton, is slightly arcuate. As a result, in the preferred embodiment a minimum width for the dispenser aperture is provided adjacent the carton corner. Thus, the necessary flexing of the carton paperboard is limited to a relatively small portion of the aperture, thereby reducing the likelihood of tearing of the paperboard during can removal. Indeed, at the opposite end of the dispenser opening, the width may be approximately equal to the can diameter.

Also, it will be recognized that arcuate tear lines 118 and 124 must be of an arrangement that when the dispenser means is opened, less than the entire can is exposed. Otherwise, the can could slip laterally from the carton. Preferably, tear lines 118 and 124 are arranged so that cover flap 110 extends into the respective top or bottom wall panel at its greatest distance to an extent less than the can diameter.

It should be recognized that while flap 110 is shown as hingedly connected to side wall panel 14, it would be possible to replace the connecting fold line by a perforated tear line. In such a case, opening of the dispenser means could be accomplished by complete removal of the closure flap 110.

It should be recognized that while in the preferred embodiment, the dispenser of the present invention is used with a carton for packaging two tiers of cans, the dispenser means may also be used with a carton for packaging only a single tier. In such a case, the carton is provided with a single dispenser aperture, constructed to have the length and width characteristics as described herein.

What is claimed is:

1. In a package for storing beverage containers such as cans of predetermined height and diameter in two or more axially-stacked tiers, the package including a carton having interconnected top, bottom and side walls, and end closure structure connected to at least some of said walls for closing one end of the carton, the containers arranged within the carton with their axes parallel to said side walls, a dispenser for the containers comprising:

first and second apertures defined in said end closure structure, said first aperture extending from one of said side walls and said bottom wall into said end closure structure, and said second aperture extending from said one side wall and said top wall into said end closure structure, said first and second apertures terminating remote from each other such that a portion of said end closure structure extends between said apertures and is connected to said one side wall.

2. The dispenser as claimed in claim 1, wherein said first and second apertures define extension portions which extend partially into adjacent portions of said bottom and top walls respectively.

3. The dispenser as claimed in claim 2, wherein said extension portions are defined at least in part by an aperture edge, the distance between said end closure structure and a portion of said aperture edge most remote therefrom being less than said diameter of the beverage container.

4. The dispenser as claimed in claim 1, wherein said first and second apertures are each covered by an at least partially removable cover flap.

5. The dispenser as defined in claim 4, wherein said cover flap is removably connected to said end closure structure along a perforated tear line.

6. The dispenser as defined in claim 5, wherein said cover flap is connected to said side wall along a fold line.

7. The dispenser as defined in claim 1, wherein said first and second apertures defined in said end closure structure each extend therealong from respective ones of said top wall and said bottom wall to define a length for each of said apertures less than said container height.

8. The dispenser as defined in claim 1, wherein said first and second apertures defined in said end closure structure each extend therealong from said one of said side walls to define a width for each of said apertures that along at least a portion of said aperture is less than said container diameter.

9. The dispenser as defined in claim 8, wherein said aperture is of a width less than said container diameter adjacent to the respective one of said top wall and said bottom wall.

10. The dispenser as defined in claim 1, wherein the package further comprises an insert panel positioned within the carton to divide the tiers, said panel along one end thereof being disposed adjacent to said end closure structure.

11. The dispenser as defined in claim 10, wherein said insert panel is attached to an inner surface of said end closure structure, at least in part along said portion thereof that extends between said apertures.

12. A blank for forming a carton for packaging beverage containers such as cans of predetermined height and diameter in two or more axially-stacked tiers, the blank including sequentially interconnected top, side and bottom wall panels, and first and second major end flaps connected to a side edge of each of said top and bottom wall panels respectively and extending outwardly therefrom to an outer edge, a dispenser for the containers comprising:

first and second removable cover panels defined along tear lines in said first and second major end flaps respectively, said first cover panel extending from said bottom wall panel along a side edge of said first major end flap closest to one of said side wall panels, and terminating along said first major end flap remote from said outer edge thereof, said second cover panel extending from said top wall panel along a side edge of said second major end flap closest to said one side wall panel, and terminating along said second major end flap remote from said outer edge thereof.

13. The blank as claimed in claim 12, wherein said first and second cover panels define extension portions which extend partially into adjacent portions of said bottom and top walls respectively.

14. In a package for beverage containers such as cans of predetermined height and diameter, the package including a carton having interconnected top, bottom and side walls, and end closure structure connected to at least some of said walls for closing one end of the carton, the containers arranged within the carton in at least a single tier with their axes parallel to said side walls, a dispenser for the containers comprising:

a first aperture defined in said end closure structure, said first aperture extending from one of said side walls and one of said bottom and top walls into said end closure structure, said first aperture extending therealong from said one of said top wall and said bottom wall to define a length for said first aperture less than said container height, and extending along said end closure structure from said one of said side walls to define a width for said first aperture that along at least a portion of said aperture is less than said container diameter.

15. The dispenser as defined in claim 14, wherein the containers are arranged within said carton in two axially-aligned tiers, and further comprising a second aperture defined in said end closure structure, said second aperture extending from said one of said side walls and another of said bottom and top walls into said end closure structure, said second aperture extending therealong from said another of said top wall and said bottom wall to define a length for said second aperture less than said container height, and extending along said end closure structure from said one of said side walls to define a width for said second aperture that along at least a portion of said aperture is less than said container diameter.

* * * * *